United States Patent [19]

Raghavan et al.

[11] Patent Number: 4,972,199

[45] Date of Patent: Nov. 20, 1990

[54] LOW CROSS-POLARIZATION RADIATOR OF CIRCULARLY POLARIZED RADIATION

[75] Inventors: Krishnan Raghavan, Redondo Beach; Dean N. Paul; Paramjit S. Bains, both of Los Angeles, all of Calif.

[73] Assignee: Hughes Aircraft Company, Los Angeles, Calif.

[21] Appl. No.: 331,422

[22] Filed: Mar. 30, 1989

[51] Int. Cl.[5] ..... H01Q 19/00

[52] U.S. Cl. ..... 343/756; 343/776; 343/786

[58] Field of Search ..... 343/756, 777, 778, 772, 343/776, 786

[56] References Cited

U.S. PATENT DOCUMENTS

| | | | |
|---|---|---|---|
| 3,413,641 | 11/1968 | Turrin | 343/786 |
| 3,564,552 | 2/1971 | Fraizer, Jr. | 343/778 |
| 3,633,208 | 1/1972 | Ajioka | 343/778 |
| 3,662,393 | 5/1972 | Cohn | 343/786 |
| 3,680,145 | 7/1972 | Beguin | 343/786 |
| 3,731,236 | 5/1973 | DiTullio et al. | 343/756 |
| 4,141,015 | 2/1979 | Wong et al. | 343/756 |
| 4,442,437 | 4/1984 | Chu etal. | 343/786 |
| 4,710,776 | 12/1987 | Roederer et al. | 343/778 |
| 4,757,324 | 7/1988 | Dhanjal | 343/772 |

OTHER PUBLICATIONS

"A New Horn Antenna with Suppressed Sidelobes and Equal Beamwidths" by P. D. Potter, The Microwave Journal, vol. 6, pp. 71–78, Jun. 1963.

*Primary Examiner*—Rolf Hille
*Assistant Examiner*—Hoanganh Le
*Attorney, Agent, or Firm*—Robert A. Westerlund; Steven M. Mitchell; Wanda K. Denson-Low

[57] ABSTRACT

An antenna is constructed of an array of contiguous circular cylindrical radiators each of which extends forwardly of a radiator assembly producing two circularly polarized waves of opposite direction of rotation of their respective electric fields. The radiators measure one wavelength at the transmit frequency band, and approximately 1.5 wavelengths in diameter at the receive frequency band. A section of cylindrical waveguide in the back of each radiator assembly encloses a microwave structure for generating the circularly polarized waves, the microwave structure including an orthomode transducer at the back of the assembly and an electric field rotator disposed forward of the orthomode transducer. In each radiator assembly, there is disposed between the rotator and the radiator a transition between smaller diameter waveguide to larger diameter waveguide. The transition may have the form of a step or a flare for a more gradual transition. The transducer produces a higher order $TM_{11}$ mode which is evanescent within the radiator 24. By attenuating the transverse magnetic mode, a match is made between electric field components thereof and those of curved electric fields of the dominant propagating modes to cancel curvature and reduce cross polarization between the two circularly polarized waves in each radiator.

12 Claims, 2 Drawing Sheets

LOW CROSS-POLARIZATION RADIATOR OF CIRCULARLY POLARIZED RADIATION

BACKGROUND OF THE INVENTION

This invention relates to the radiation of circularly polarized radiation from an array of radiators and, more particularly, to the inhibiting of cross polarization among neighboring cylindrical radiators in an array antenna of the radiators for improved isolation of left hand and right hand circularly polarized signals.

Communication systems frequently employ antennas for communicating over long distances. For example, the communication systems employing a satellite encircling the earth may employ a microwave electromagnetic link between the satellite and a transmitting-/receiving station on the earth. In order to provide well-defined microwave beams, it is common practice to employ an antenna on the satellite with the antenna being constructed of a plurality of radiating elements, or radiators, arranged in an array. Typically, a reflector of microwave energy is positioned in front of the radiators to aid in focusing rays of radiation to provide a desired narrow beam directed to the station on the earth.

One form of radiated signal which is employed in communication systems is a circularly polarized electromagnetic signal. A single radiator can radiate simultaneously a circularly polarized wave of clock-wise or left-hand circular polarization, and a circularly polarized wave of counter clockwise or right-hand circular polarization. Preferably, the electric field of one of the waves is orthogonal, or perpendicular, to the electric field of the other wave so as to ensure that the two waves can be received separately without interfering with each other. This permits two separate signals to be transmitted at the same carrier frequency for a doubling of the data capacity of the communication link without increasing the frequency spectrum. Microwave structures for the simultaneous generation of orthogonal circularly polarized waves have been employed often in communication systems to take advantage of the increased channel capacity.

Of particular interest herein is an array antenna transmitting signals at one frequency and receiving signals at a second frequency which is higher than the transmitting frequency. The signals on transmission employ both left and right-handed circularly polarized waves, and the signals upon reception employ both left and right hand circularly polarized waves. It is of interest to provide a desired directivity pattern to the transmitted beam, as well as the received beam of microwave radiation.

As is well known, the spacing, on centers, between radiators of the array is an important parameter in establishing a desired radiation pattern. Herein, a specific radiator spacing is to be employed, namely, a spacing equal to one wavelength of the transmitted radiation. Since the received radiation is at a higher frequency, the effective radiator spacing is greater than one wavelength for the received radiation. In addition, the array under consideration herein is to employ cylindrical radiators arranged side-by-side in the array. Typically, such cylindrical radiators are configured as circular sections of thin-walled circular waveguide.

A problem arises in that the electric fields of the transverse-electric wave which is the dominant mode in the cylindrical waveguide may depart somewhat from perfect linearity across the radiating aperture of a radiator. For example, an electric field vector located at the center of the radiating aperture may be perfectly straight while electric field vectors displaced to the right and to the left of the central vector may be partially bowed. Ideally, all of the electric vectors of one circularly polarized wave at the plane of the radiating aperture should be straight, or linear, rather than bowed, and should be perpendicular to the corresponding electric field vectors of the other circularly polarized wave. However, due to the bowing of the electric field in each wave, there is a small vector component of one wave which is parallel to a small vector component of the other wave allowing for a cross-coupling of signals upon reception of the respective waves at the station on the earth or at the satellite. Such cross coupling, or cross polarization, is to be avoided as much as is possible to insure highest quality reception of signals communicated by the array antenna. The forgoing problem exists both in the case of transmission from an array of radiators as well as in he transmission from a single radiator.

SUMMARY OF THE INVENTION

The foregoing problem is overcome and other advantages are provided by the construction of a radiator assembly, whether used singly or as a part of an array, having a transition between two cylindrical waveguide sections of differing diameters. One of the sections, to be referred to as a front section, extends forward of the transition to serve as a radiator. The other waveguide section, to be referred to as the back section, extends rearward of the transition to house a quarter-wave plate, or polarizer, and an orthomode transducer by which two input microwave signals are coupled to a back wall and a sidewall of the back waveguide section to become orthogonally polarized transverse electric waves. The two waves propagate forward through the quarter-wave plate, the latter having differing speeds of propagation along different axes of the plate, as is well known, to effect a rotation of the electric vector of each wave. This produces circularly polarized radiation from each of the waves, with one wave having clockwise polarization and the other form having counter clockwise polarization as viewed from the front of the radiator. The back waveguide section is of smaller diameter than the front waveguide section, the diameter of the front waveguide section being approximately one wavelength .

In accordance with the invention, the transition converts a portion of the microwave energy in each of the waves to a higher order transverse magnetic wave which is an evanescent mode of wave in the front waveguide section. The transverse magnetic mode requires a larger diameter waveguide, than the one-wavelength diameter provided by the front waveguide section, to be a propagating mode. Due to the restriction in size of only one wavelength, the higher-order transverse-magnetic wave attenuates during passage through the front section, the amount of attenuation increasing with increased distance of travel along the front section in accordance with an exponential decay in wave amplitude.

It has been observed that the electric fields of the transverse magnetic wave interact with the cross-polarization components of the electric field vectors of the circularly polarized transverse-electric waves so as to cancel the bowing of the electric fields. This produces straight or linear electric field vectors across the radiating aperture. Thereby, the undesired cross coupling of signals associated with the cross polarization is significantly reduced for improved communication of the signals of the respective circularly polarized waves. The amount of cancellation of the bowing of the electric vectors is dependent on the accuracy with which the magnitude of the electric fields of the transverse-magnetic wave is matched to the cross-polarizing components of the bowed electric vectors of the transverse-electric waves.

In the preferred embodiments of the invention, the desired magnitude of the transverse-magnetic wave is attained by adjusting the parameters of the transition to provide a somewhat larger magnitude of transverse-magnetic wave, than is necessary for the cancellation, and then reducing the magnitude of the transverse magnetic waves by an appropriate selection of length of the front waveguide section. The reduction in amplitude produces the desired amount of transverse-magnetic wave at the radiating aperture of the radiator for accurate cancellation of the bowing of the electric fields. The transition may be constructed, in one embodiment of the invention, as a step transition, and in a second embodiment of the invention, as a conically flared transition.

BRIEF DESCRIPTION OF THE DRAWING

The aforementioned aspects and other features of the invention are explained in the following description, taken in connection with the accompanying drawing wherein.

DETAILED DESCRIPTION

Figure 1:
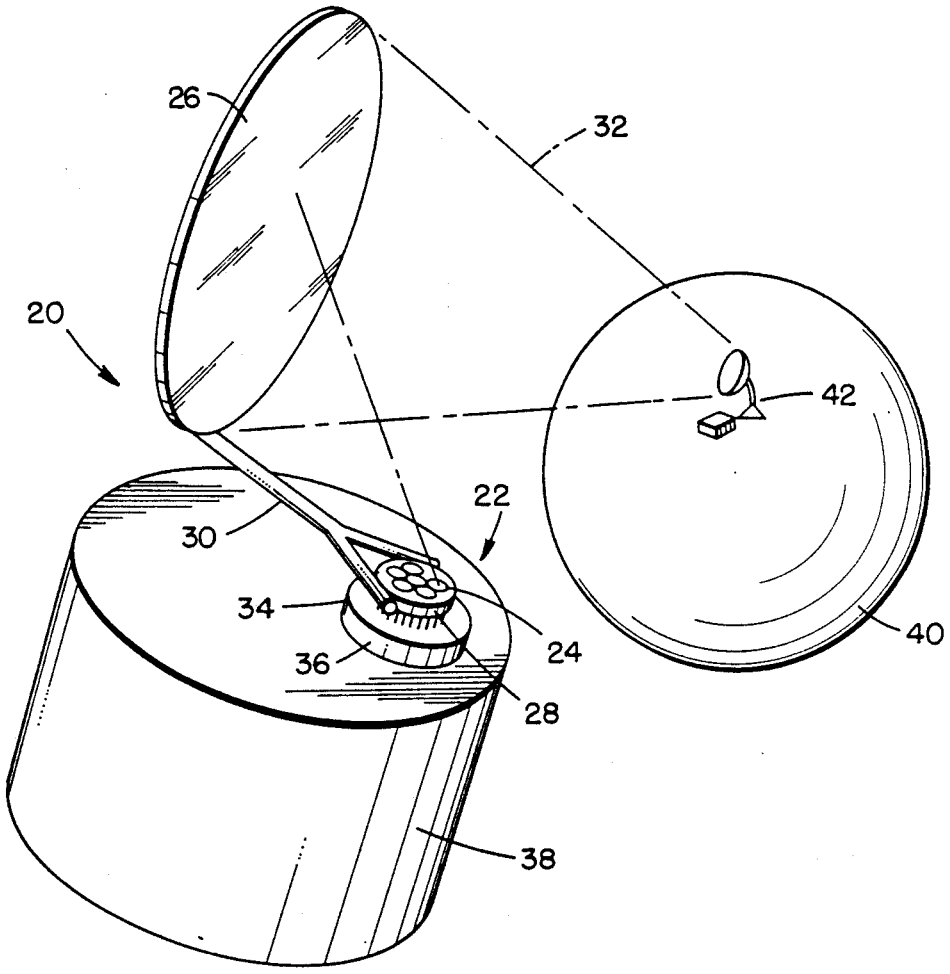
FIG. 1 shows a stylized view, partially diagrammatic, of an array of cylindrical radiators energized to provide circularly polarized radiation of both hands, and including a transition in each radiator assembly for generating a circular $TM_{11}$ wave to inhibit cross polarization, the array being presented by way of example as part of an antenna system carried by a satellite encircling the earth.

With reference to FIG. 1, there is shown an antenna 20 comprising an array 22 of radiators 24 facing a reflector 26. The radiators 24 are supported within a base 28, and the reflector 26 is secured in position relative to the radiators 24 by an arm 30 extending from the base 28. The reflector 26 has a curved concave reflecting surface, such as a paraboloid, facing the array 22 for focussing radiation from the radiators 24 to form a beam 32. The array 22 is offset from a central axis of the reflecting surface so as to avoid any blockage of the beam 32 by the radiators 24.

The antenna 20 is part of an antenna system 34 which includes electronic and microwave circuitry 36 for processing signals transmitted and received by the radiators 24, and for forming the beam 32. By way of example in the use of the antenna system 34, the system 34 is depicted as part of a satellite 38 encircling the earth 40 for communicating with a station 42 on the earth 40.

Figure 2:
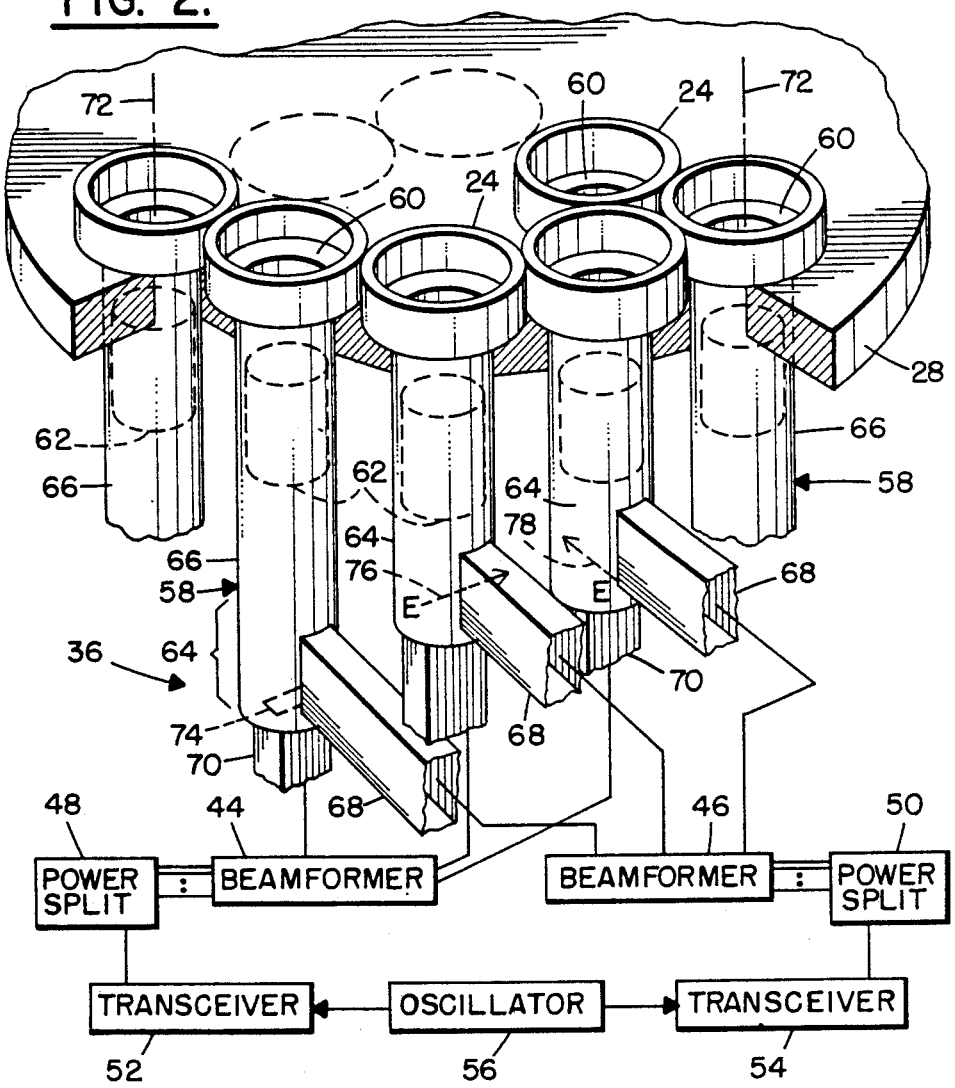
FIG. 2 is a diagrammatic view of details of signal processing circuitry of the antenna system including interconnections of the radiators with beamformers.

With reference also to FIG. 2, the circuitry 36 comprises two beamformers 44 and 46 coupled to the radiators 24 for forming, respectively, left-hand and right-hand circularly polarized portions of the beam 32. The circuitry 36 further comprises two power splitters 48 and 50 and two transceivers 52 and 54 connected, respectively, by the power splitters 48 and 50 to the beamformers 44 and 46. An oscillator 56 provides a common carrier signal to both transceivers 52 and 54 for phase synchronization of signals outputted by the two beamformers 44 and 46. It is to be understood that the radiators 24 and the beamformers 44 and 46 operate reciprocally for the generation of the beam 32 during transmission of electromagnetic signals from the radiators 24 to the ground station 42, and during reception of signals from the ground station 42 by the radiators 24.

Each radiator 24 is part of a radiator assembly 58, there being a plurality of the radiator assemblies 58, one for each radiator 24. Each radiator assembly 58 includes a transition 60, a quarter-wave rotator 62, and an orthomode transducer 64. The transition 60 is described in further detail in FIGS. 3 and 4, wherein a step embodiment and a flared embodiment of the transition are shown respectively at 60A and 60B in FIGS. 3 and 4. The rotator 62 and the transducer 64 are formed within a back waveguide section 66 of the radiator assembly 58, the section 66 having the shape of a right circular cylinder. The radiator 24 in each assembly 58 is formed as a section of right-circular cylindrical waveguide at the front of the assembly 58. In each assembly 58, the front and back waveguide sections are joined by the transition 60. The rotator 62 is located between the transducer 64 and the transition 60.

The orthomode transducer 64 is constructed in a well-known fashion and comprises two waveguides 68 and 70 which are of rectangular cross section and have end walls which abut the back waveguide section 66. Both of the waveguides 68 and 70 have opposed broad walls joined together by narrow walls, such as a 2:1 ratio of width of broad wall to width of narrow wall. A transverse electric (TE) wave propagates in each of the waveguides 68 and 70 with the electric field being disposed parallel to the narrow sidewall. The waveguide 68 abuts the cylindrical sidewall of the waveguide section 66 with the broad wall of the waveguide 68 being parallel to the longitudinal axis 72 of the radiator assembly 58. The waveguide 70 abuts an end wall of the waveguide section 66 and is rotated about the longitudinal axis 72 of the radiator assembly 58 to orient the waveguide 70 with a broad wall thereof facing a narrow wall of the waveguide 68. The end walls of both of the waveguides 68 and 70 are substantially open to provide slots, such as slot 74 shown in phantom, to allow coupling of the electric fields of the waves in each of the waveguides 68 and 70 into the waveguide section 66 at the site of the transducer 64. Two of the coupled electric fields are indicated at 76 and 78, respectively, for the waveguides 68 and 70. The two electric fields 76 and 78 are oriented transversely to the longitudinal axis 72.

The electric fields 76 and 78 are components of TE waves which have a mode which propagates in a cylindrical waveguide. These waves propagate along the axis 72 toward the rotator 62. As is well known in the operation of rotators, fast and slow transmission planes of the rotator 62 are angled, about the axis 72 relative to the electric fields 76 and 78 so that a component of each of these fields propagates along the fast plane while another component of each of these fields propagates along the slow plane. This produces a difference of phase of 90 degrees between the two components of each of the cylindrical waves. The 90 degree phase shift results in a rotation of the electric field vector in each of the cylindrical waves such that the electric field 76 introduced from the waveguide 78 rotates with left hand circular polarization within the radiator 24, and the electric field 78 introduced by the waveguide 70 rotates with right-hand circular polarization in the radiator 24.

The two beamformers 44 and 46 are constructed in the same fashion. By way of example, each of the beamformers 44 and 46 may be constructed as a well-known array of interconnecting phase shifters and power dividers as in a Butler matrix. The back waveguide sections 66 of the various radiator assemblies 58 may be varied in length to accommodate spacing of the waveguides 68 and 70. Attenuators and additional phase shifters, or delay elements, (not shown) may be employed in output channels of the beamformers 44 and 46 to alter signal strengths and phases among the output channels of the beamformers to compensate for different lengths of microwave lines interconnecting output ports of the beamformers to the orthomode transducers 64, as well as to compensate for variations in the lengths of the back waveguide sections 66.

Figure 4:
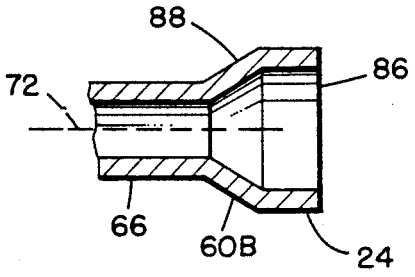
FIG. 4 shows a conical transition in a radiator assembly.
Figure 5:
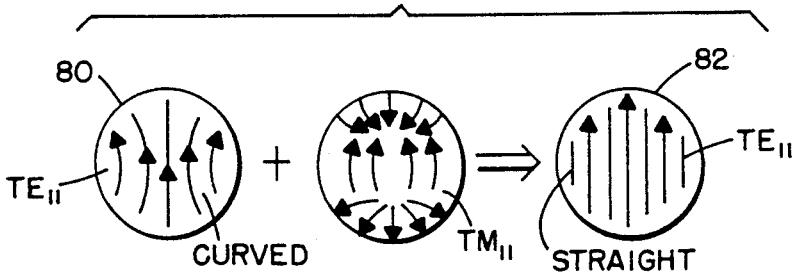
FIG. 5 shows schematically a conversion of curved electric field lines to straight electric field lines by use of a transverse magnetic wave of the $T_{11}$ mode.

In accordance with the invention, the electric field of either of the circularly polarized waves in a radiator 24 would, in the absence of the invention, be partially straight and partially bowed as depicted at 80 in FIG. 5. By combining a transverse magnetic wave of higher order mode with the bowed electric fields, as indicated in FIG. 5, the invention provides for the straightening of the bowed fields to produce the straightened electric fields as depicted at 82. The generation of the transverse magnetic wave is accomplished with the aid of the transition 60. The embodiment of the transition 60A of FIG. 3 introduces a relatively narrow bandwidth to the radiator assembly 58 while the use of the embodiment of the transition 60B of FIG. 4 introduces a relatively wide bandwidth to the radiator assembly 58.

The preferred embodiment of the invention is to be employed in the situation wherein transmission is to be accomplished in a frequency band which is lower than a frequency band to be employed for reception. The narrow bandwidth of the transition 60A of FIG. 3 precludes its use only to the transmission of signals from the antenna 20. However, if the antenna 20 is to be employed for both transmission and reception, with the transmission at the lower frequency band and reception at the higher frequency band, then the transition 60B of FIG. 4 is to be employed in the construction of the radiator assembly 58. In the construction of the preferred embodiment of the invention, the transmission frequency band extends from 11.771–12.105 GHz (gigahertz), and the receiving frequency band extends from 17.371–17.705 GHz.

Figure 3:
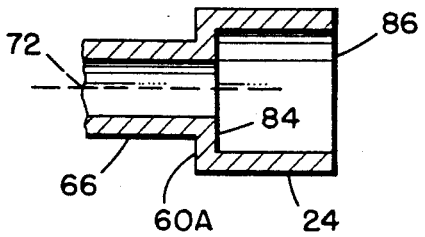
FIG. 3 shows a step transition in a radiator assembly.

With reference to the sectional view of the transition 60A of FIG. 3, and the sectional view of the transition 60B of FIG. 4, the inner diameter of the front waveguide section, or radiator 24, is 1.000 inch in both embodiments of the transition. The cylindrical walls of the radiator 24 are relatively thin, approximately 30 mils thick, as compared to the inner diameter of the radiator 24 so as to allow for the approximately one-inch spacing on centers between radiators of the array 22 (FIG. 2). The radiator 24, the back waveguide section 66, and the transition 60 of an assembly 58 are fabricated of a metal such as copper, bronze or aluminum. The same metal may be employed in the construction of the base 28 which supports the assemblies 58. The inner diameter of the back waveguide section 66 in both embodiments of the transition is 0.692 inch. In the transition 60A, a length of the sidewalls of the radiator 24, as measured from a step 84 of the transition 60A to a radiating aperture 86 is 0.675 inch. In the transition 60B, the back waveguide section 66 is spaced apart from the radiator 24 by a flared frusto-conical section 88, the section 88 having a length of 0.30 inch as measured along the axis 72 of the transition 60B. In the transition 60B, the length of the radiator 24 as measured along the axis 72 is 0.375 inch. The foregoing dimensions for the transition 60A are employed at a center frequency of the transmit band, namely, a frequency of 11.938 GHz.

In the operation of the transducer 60, including both the embodiments 60A and 60B, the dominant mode of propagating wave established within the back waveguide section 66 is the $TE_{11}$ mode in the transmit band because other modes cannot exist in a circular waveguide of the foregoing diameter. At the center frequency of the transmit band, the inner diameter of the back waveguide section 66 is approximately 70% of the free-spaced wavelength. The diameter of the radiator 24, as noted above, is equal to one free-space wavelength. Thus, the cross-sectional area of the front waveguide section is approximately double the cross-sectional area of the back waveguide section. The effect of the transition 60, whether considering the embodiment 60A or 60B, is to generate a higher order mode of transverse magnetic wave, namely the $TM_{11}$ mode.

In accordance with an important feature of the invention, the one-wavelength diameter of the radiator 24 is too small to sustain propagation of the $TM_{11}$ mode. Therefore, the $TM_{11}$ mode is evanescent in the transmit frequency band resulting in an exponential decay in the amplitude of the transverse magnetic wave as a function of distance along the axis 72 from the transition 60A or 60B at the back end of the radiator 24 up to the radiating aperture 86 at the front end of the radiator 24. At the receive frequency band, which is centered at a frequency almost 50% greater than that of the transmit band, the diameter of the radiator 24 as measured in wavelengths is sufficiently large to allow for propagation of the transverse magnetic wave in the $TM_{11}$ mode from the radiating aperture 86 at the front end of the radiator 24 through the radiator 24 to the transmission 60B at the back end of the radiator 24. The conical shape of the transmission 60B provides sufficient bandwidth to allow for propagation of electromagnetic energy in the receive frequency band from the radiator 24 into the back waveguide section 66. However, the significantly narrower bandwidth of the step-shaped transition 60A reduces the bandwidth of the radiator assembly 58 so as to preclude its use at both the transmit and receive frequency bands. Therefore, as has been noted hereinabove, if the transition 60A is to be employed, then its use is restricted only to the transmit band.

The theory of operation of the invention, as demonstrated in FIG. 5, requires that the curved portions of the electric field, shown at 80, be made straight, as shown at 82. A curved portion of electric field can be described by two vector components, one of which is parallel to the general direction of the electric field, and the other of which is transverse to the general direction of the electric field. The transverse component is parallel to the electric field of the circularly polarized wave of the opposite hand resulting in cross polarization of the two waves and the resultant interference between the signals of the two polarized waves during communication of the two signals. The directions of the electric fields in the $TM_{11}$ mode are such as to cancel the transverse components of the curved electric field resulting in the desired straight electric field. It has been found that an amplitude of the $TM_{11}$ mode which is equal to approximately 6 percent of the amplitude of the dominant $TE_{11}$ mode is of the proper value to produce the desired cancellation of the transverse components of the electric field so as to remove the undesirable curvature of the electric field.

In the practice of the invention the size of the transition 60 is selected to produce an amplitude of the $TM_{11}$ mode which is larger than the foregoing 6 percent. The length of the front waveguide section of the radiator 24 is selected to attenuate the amplitude of the transverse magnetic wave to bring it to the desired value of 6 percent. The foregoing value of 6 percent produces significant reduction of the electric field curvature. However, still further reduction can be attained empirically by further adjustment of the length of the radiator 24 to match more precisely the electric field components of the transverse magnetic wave with the transverse components of the curved electric field vectors.

The amount of the transverse magnetic wave produced depends on the magnitude of the transition, namely, the ratio of the inner diameters of the radiator 24 and the back waveguide section 66, and also on the physical shape of the transition. A larger ratio of the diameters produces a larger amplitude of the transverse magnetic wave. For a given ratio of the diameters, the step shape of the transition 60A creates a larger amplitude of transverse magnetic wave than does the flared conical shape of the transition 60B. As a result, the axial length of the radiator 24 in FIG. 3 is longer than the corresponding dimension in FIG. 4, namely 0.675 inch versus 0.375 inch, to provide the additional attenuation of the transverse magnetic field required for the embodiment of FIG. 3 as compared to the embodiment of FIG. 4. These principles of the invention apply also to other embodiments of cylindrical waveguides such as a waveguide constructed of solid dielectric material.

With respect to the operation of the antenna system 34, the two circularly polarized waves propagate independently of each other because of the orthogonal relationship of the electric field vectors 76 and 78 (FIG. 2), wherein in a transverse plane of the radiator assembly 58, the two electric field vectors are perpendicular to each other. The orthomode transducer 64 operates during reception to separate the two circularly polarized waves so that a signal carried by one wave exits via the waveguide 68 and a signal carried by the other wave exits via the waveguide 70. The signals from the orthomode transducers 64 of the respective radiator assemblies 58 are combined in the separate beamformers 46 and 44 to be applied, respectively, by the power splitters 50 and 48 to the transceivers 54 and 52 for separate reception of the two signals. During transmission, two signals are separately generated by each of the transceivers 54 and 52 for coupling via the waveguides 68 and 70 to a radiator assembly 58. During transmission, energy from the two circularly polarized signals is converted to the higher order transverse magnetic mode for cancellation of curvature of the electric field thereby to remove cross polarization within each radiator 24 to insure that there is no significant interference between the signals carried by the two circularly polarized waves.

For the foregoing values of the transmit and receive frequency bands, the use of the one inch diameter radiators provides a radiating aperture which is substantially one wavelength at the frequencies of the transmit band and approximately 1.5 wavelengths at the frequencies of the receive band. This produces a very low level of cross-polarization at both frequency bands. By way of comparison to other forms of radiators, it is noted that if conically shaped horns were used as the feed elements, instead of the cylindrical radiators 24, such an array would produce an undesirable high level of cross-polarized signals in the far-field radiation pattern of the array of radiators. The feed horns of the invention, namely the cylindrically shaped radiators 24, minimize cross polarization throughout both the transmit and the receive frequency bands.

The antenna 20 reduces the cross-polarized component of circular polarization over a wide range of directions of propagation, namely, up to 40 degrees off of the axis of the array 22 in all directions about the axis, which solid angle is the subtended angle of the parabolic reflector 26. The radiation directivity pattern of the antenna 20 shows significant improvement both at the transmit and the receive band frequencies over those produced by an antenna employing another form of radiator, such as an array of conical horns. This is based on the use on the higher order $TM_{11}$ mode wherein, at the transmit frequency, the one-wavelength diameter of the radiator 24 is too small to sustain propagation, but at the 1.5 wavelength diameter at the receive frequency band does support propagation of the transverse magnetic wave. For a given ratio of diameters at the transition 60B, the amplitude of the $TM_{11}$ mode can be adjusted also by selection of the angle of the flare section. In addition to reducing the cross polarization within each of the radiators 24, the modified aperture distribution of each radiator 24 provided by the $TM_{11}$ mode also reduces degradation of radiation pattern produced by mutual coupling among the radiators of the array 22.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A system for radiating circularly polarized electromagnetic waves comprising:

an array of cylindrical radiator assemblies disposed side by side with a spacing on centers of substantially one wavelength, each of said radiator assemblies including generating means responsive to two microwave signals inputted at the radiator assembly for generating a clockwise circularly polarized wave in response to a first of said microwave signals and a counterclockwise circularly polarized wave in response to a second of said microwave signals, the clockwise and the counterclockwise waves being transverse electric waves and being orthogonal to each other.

means for applying said two microwave signals to said generating means in each of said radiator assemblies; and linearizing means within each of said radiator assemblies for linearizing transverse electric fields of said circularly polarized waves to inhibit cross polarization of waves radiated by said radiator assemblies; and wherein each of said radiator assemblies comprises a front cylindrical waveguide section of a first cross-sectional area and a back cylindrical waveguide section of a second cross-sectional area smaller than said first cross-sectional area, said front waveguide section serving as a cylindrical radiator of the radiator assembly, said back waveguide section connecting with said generating means;

said linearizing means comprises a transition converting a portion of dominant transverse electric (TE) waves to a higher order evanescent mode of transverse magnetic (TM) wave for interaction with the transverse electric waves to linearize the transverse electric waves;

in each of said radiator assemblies, said transition comprises a transverse wall extending outward from a front end of the back section to a back end of the front section; and in each of said radiator assemblies, said cylindrical radiator has a circular cross-section with diameter of approximately one wavelength of radiation to be transmitted by the radiator, the diameter of said cylindrical radiator being sufficiently small to inhibit propagation of the higher order mode of TM wave to produce the evanescent mode, and the axial length of said radiator is less than approximately two-thirds the diameter of said radiator to reduce the amplitude of said TM wave to approximately six percent of the amplitude of said TE wave to cancel cross polarization.

2. A radiating system according to claim 1 wherein, in each of said radiator assemblies, said transverse wall is planar metallic wall lying transverse to a longitudinal axis of the radiator assembly.

3. A radiating system according to claim 1 wherein, in each of said radiator assemblies, said transverse wall is configured as a metallic conic section positioned symmetrically about a longitudinal axis of the radiator assembly.

4. A radiating system according to claim 1 wherein, in each of said radiator assemblies, said second cross-sectional area is approximately one-half said first cross-sectional area.

5. A system for radiating circularly polarized electromagnetic waves comprising;

a cylindrical radiator having a radiating aperture of substantially one wavelength in diameter;

generating means responsive to two microwave signals inputted to the generating means for generating a clockwise circularly polarized wave in response to a first of said microwave signals and a counterclockwise circularly polarized wave in response to a second of said microwave signals, the clockwise and the counterclockwise waves being transverse electric waves and being orthogonal to each other, said generating means applying said circularly polarized waves to said radiator to be radiated from said radiator; and transition means interconnecting said generating means with a back side of said radiator opposite said radiating aperture for linearizing transverse electric fields of said circularly polarized waves to inhibit cross polarization of waves radiated from said radiating aperture; and wherein said generating means comprises a cylindrical waveguide section having a diameter smaller than the diameter of said radiating aperture;

said transition means comprises a transition converting a portion of the transverse electric (TE) waves to a higher order evanescent mode of transverse magnetic (TM) wave for interaction with the transverse electric waves to linearize the transverse electric waves, said transverse magnetic wave decreasing in amplitude during passage through said cylindrical radiator to the radiating aperture;

said transition comprises a transverse wall extending outward from a front end of the waveguide section to a back end of the radiator opposite the radiating aperture, said evanescent mode being present in said radiator;

said cylindrical radiator has a circular cross-section with diameter of approximately one wavelength of radiation to be transmitted by the radiator, the diameter of said cylindrical radiator being sufficiently small to inhibit propagation of the higher order mode of TM wave to produce the evanescent mode, and the axial length of said radiator is less than approximately two-thirds the diameter of said radiator to reduce the amplitude of said TM wave to approximately six percent of the amplitude of said TE wave to cancel cross polarization.

6. A radiating system according to claim 5 wherein said transverse wall is a metallic planar wall lying transverse to a longitudinal axis of the radiator.

7. A radiating system according to claim 5 wherein said transverse wall is configured as a metallic conic section positioned symmetrically about a longitudinal axis of the radiator.

8. A radiating system according to claim 5 wherein said waveguide section has a cross-sectional area equal to approximately one-half a cross-sectional area of said radiator.

9. A cylindrical radiator assembly for use in a system providing for a radiating of circularly polarized electromagnetic waves, the system including generating means responsive to two microwave signals inputted to the generating means for generating a clockwise circularly polarized wave in response to a first of said microwave signals and a counterclockwise circularly polarized wave in response to a second of said microwave signals, the clockwise and the counterclockwise waves being transverse electric waves and being orthogonal to each other, the radiator assembly comprising:

a cylindrical radiator having a radiating aperture of substantially one wavelength in diameter, said generating means applying said circularly polarized waves to said radiator to be radiated from said radiator; and transition means interconnecting said generating means with a back side of said radiator opposite said radiating aperture for linearizing transverse electric fields of said circularly polarized waves to inhibit cross polarization of waves radiated from said radiating aperture; and wherein said generating means comprises a cylindrical waveguide section having a diameter smaller than the diameter of said radiating aperture;

said transition means comprises a transition converting a portion of the transverse electric (TE) waves to a higher order evanescent mode of transverse magnetic (TM) wave for interaction with the transverse electric waves, said transverse magnetic wave decreasing in amplitude during passage through said cylindrical radiator to the radiating aperture;

said transition comprises a transverse wall extending outward from a front end of the waveguide section to a back end of the radiator opposite the radiating aperture, said evanescent mode being present in said radiator; and the diameter of said radiating aperture is sufficiently small to inhibit propagation of the higher order mode of TM wave to produce the evanescent mode, and the axial length of said radiator is less than approximately two-thirds the diameter of said radiator to reduce the amplitude of said TM wave to approximately six percent of the amplitude to said TE wave to cancel cross polarization.

10. A radiator assembly according to claim 9 wherein said transverse wall is a planar metallic wall lying transverse to a longitudinal axis of the radiator.

11. A radiator assembly according to claim 9 wherein said transverse wall is configured as a metallic conic section positioned symmetrically about a longitudinal axis of the radiator.

12. A radiator assembly according to claim 9 wherein said waveguide section has a cross-sectional area equal to approximately one-half a cross-sectional area of said radiator.

* * * * *